United States Patent [19]

Balmforth

[11] 3,937,044

[45] Feb. 10, 1976

[54] APPARATUS FOR DYEING PILE FABRICS

[75] Inventor: Trevor Balmforth, Clitheroe, England

[73] Assignee: Stalwart Dyeing Company Limited, England

[22] Filed: July 9, 1974

[21] Appl. No.: 486,846

[30] Foreign Application Priority Data

July 17, 1973 United Kingdom ..... 33988/73

[52] U.S. Cl. ..... 68/205 R; 118/325

[51] Int. Cl.[2] ..... D06B 1/06

[58] Field of Search ..... 68/205 R, 5 D, 5 E; 118/325, 407

[56] References Cited

UNITED STATES PATENTS

| | | | |
|---|---|---|---|
| 2,578,427 | 12/1951 | Hussey et al. | 68/205 R X |
| 3,731,503 | 5/1973 | Appenzeller et al. | 68/205 R |
| 3,800,568 | 4/1974 | Takriti et al. | 68/205 R |

FOREIGN PATENTS OR APPLICATIONS

| | | | |
|---|---|---|---|
| 7,101,005 | 9/1971 | Netherlands | 68/205 R |

*Primary Examiner*—Edward L. Roberts
*Assistant Examiner*—Philip R. Coe
*Attorney, Agent, or Firm*—Watson, Cole, Grindle & Watson

[57] ABSTRACT

A method of and apparatus for dyeing a length of pile fabric moving continuously with its pile surface uppermost, the apparatus comprising a trough to contain dye liquor, a rotatable lick roller mounted in the trough with its axis extending transversely to the direction of travel of the fabric, a doctor blade extending parallel to the lick roller with its upper edge in contact with the lick roller, to pick up a film of dye liquor from the lick roller, the doctor blade having a smooth, uninterrupted upper surface, a corrugated sheet extending transversely to the direction of travel of the fabric and disposed beneath the lower edge of the doctor blade, the corrugated sheet collecting in its channels by gravity from the doctor blade a number of parallel streams of drops of dye liquor from which the drops fall directly on to the fabric, and means for imparting oscillation to the corrugated sheet in a direction transverse to the direction of travel of the fabric.

3 Claims, 1 Drawing Figure

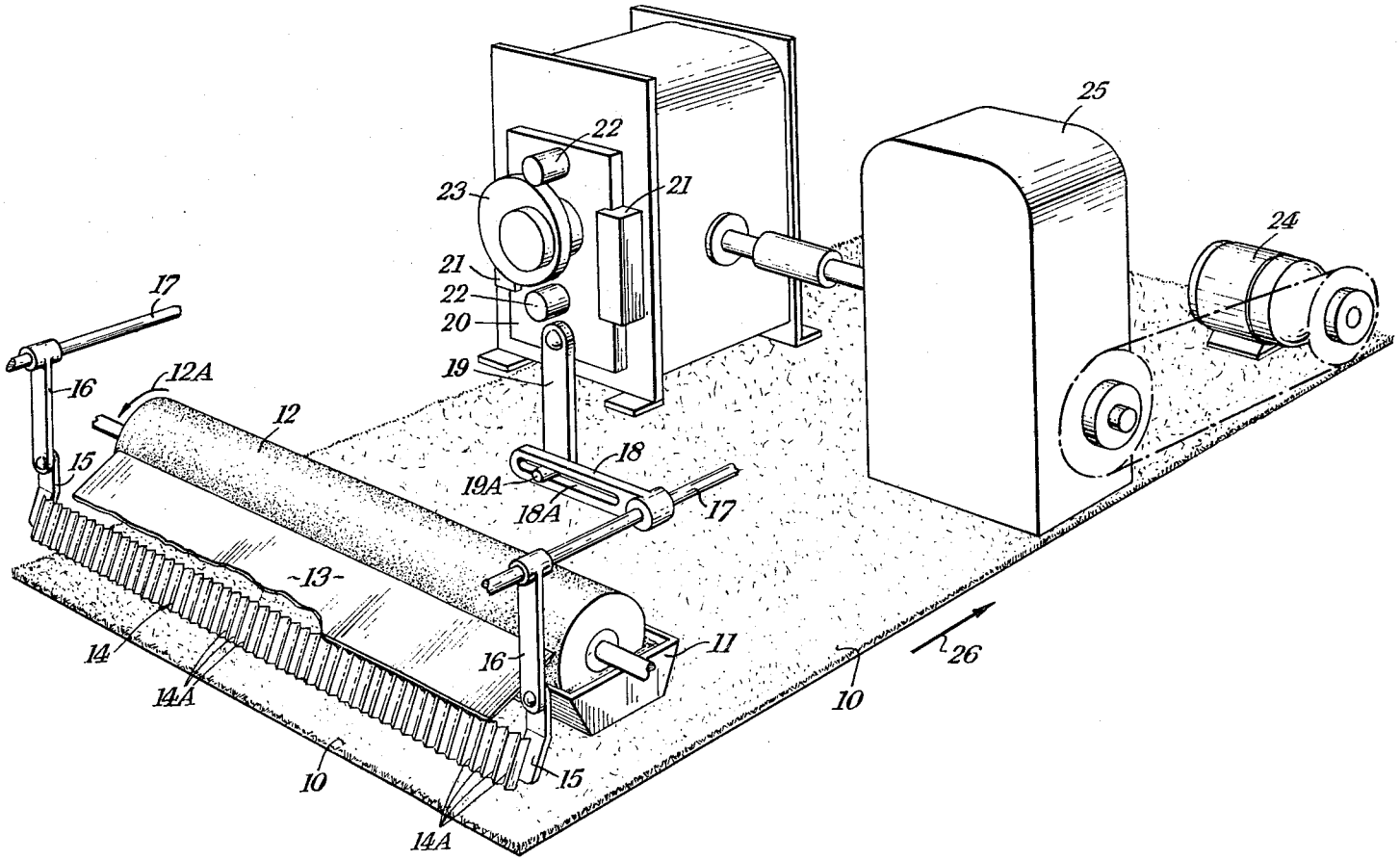
24
25
26
10
17
11
21
18
22
18A
15
19A
16
23
21
22
20
19
14A
13
10
12
12A
14A
17
14
16
15

APPARATUS FOR DYEING PILE FABRICS

It has previously been proposed to dye a pile fabirc, such for example as a tufted carpet, travelling continuously with its pile surface uppermost, with a spattered dye pattern by forming dye liquor into a film on the upper surface of a doctor blade extending transversely to the direction of travel of the fabric, the doctor blade having at its lower end formations which subdivide the dye liquor upon it into a series of parallel streams, and breaking the streams of dye liquid flowing from the lower edge of the doctor blade into individual droplets by an oscillating grid, disposed between the doctor blade and the fabric, which also scatters the droplets over the surface of the fabric.

The present invention provides a method of dyeing a pile fabric moving continuously with its pile surface uppermost, which comprises forming dye liquor into a film on a blade extending transversely to the direction of travel of the fabric, and having a smooth uninterrupted surface for receiving the film, channelling the dye liquor falling by gravity from the blade into a number of parallel streams of drops in the corrugations of a corrugated sheet disposed beneath the blade, and imparting oscillation to the corrugated sheet in a direction transverse to the direction of travel of the fabric to scatter individual drops of dye liquor from the lower ends of its corrugations directly on to the fabric.

The invention includes apparatus for dyeing a length of pile fabric moving continuously with its pile surface uppermost, comprising a trough to contain dye liquor, a rotatable lick roller mounted in the trough with its axis extending transversely to the direction of travel of the fabric, a doctor blade extending parallel to the lick roller with its upper edge in contact with the lick roller, to pick up a film of dye liquor from the lick roller, the doctor blade having a smooth, uninterrupted upper surface, a corrugated sheet extending transversely to the direction of travel of the fabric and disposed beneath the lower edge of the doctor blade, the corrugated sheet collecting in its channels by gravity from the doctor blade a number of parallel streams of drops of dye liquor from which the drops fall directly on to the fabric, and means for imparting oscillation to the corrugated sheet in a direction transverse to the direction of travel of the fabric.

Preferably, although this is not essential, the dye liquor flows from the lower edge of the doctor blade on to the corrugated sheet as individual droplets. The conditions which determine whether the dye liquor flows from the lower edge as individual droplets rather than as a film are the viscosity of the liquor, the inclination of the doctor blade and the speed of rotation of the lick roller. As the viscosity is increased more liquor is picked up by the lick roller, it flows more slowly down the doctor blade and falls off its edge more slowly in larger drops. If the doctor blade is inclined at a shallower angle the liquor flows more slowly down it, more readily forming drops at its lower edge. If the speed of the lick roller is increased more liquor is transferred onto the doctor blade and the drops fall more frequently from its lower edge eventually joining up into a continuous stream.

The corrugated sheet, which is conveniently oscillated by a cam, separates out the drops falling from the doctor blade — or when the liquor falls as a film from the doctor blade channels the film into a series of streams of drops — and drops —the drops on the fabric in a pattern determined by the profile and speed of the cam and the amplitude of movement imparted to the sheet. The effect on the fabric also depends on the number of corrugations in the sheet per unit length and on the speed of travel of the fabric.

The following is a more detailed description, by way of example, of one embodiment of the invention, reference being made to the accompanying diagrammatic drawing which is a perspective view of an apparatus for dyeing a continuously moving pile fabric.

The pile fabric 10 is in the form of a continuous length of pile fabric of predetermined width. The fabric is drawn through a number of processing stages by rollers (not shown) in a path which includes the horizontal stretch shown in the drawing along which the fabric travels with its pile surface facing upwards.

A trough 11 extends transversely across the width of the fabric 10 above its pile surface. The trough 11 is filled with dye liquor and is connected to a supply of dye liquor (not shown) whereby the level of dye liquor in the trough 11 is maintained at a constant predetermined level. A lick roller 12 is rotated, by means not shown, in the direction indicated by the arrow 12A about an axis transverse to the direction of travel of the fabric 10 and has its lower portion immersed in the trough 11. The speed of rotation of the lick roller 12 may be independently varied. A doctor blade 13 has one edge in contact with the surface of the lick roller 12 and the other edge arranged above a corrugated sheet 14 which is inclined at an angle to the plane of the fabric and which forms a number of parallel channels 14A terminating above the surface of the fabric 10.

The lower edge of the corrugated sheet 14 is bevelled so that the corrugations forming the bases of the channels are longer, in the direction of the lengths of the channels, than the corrugations forming the crests between the channels. The corrugated sheet 14 is mounted on a pair of arms 15 which are pivotally connected to further arms 16 carried on horizontal rods 17 which are mounted for rotation about their longitudinal axes. The lower edge of the corrugated sheet is about 50 mm above the pile fabric 10 although this distance may be up to 200 mm.

The right hand rod 17 carries a lever arm 18 formed with a slot 18A which forms a guide for a pin 19A carried on the end of a member 19. This member 19 is connected to a plate 20 constrained for movement in a single plane only by engagement of its edges with a pair of fixed slotted guides 21. The plate 20 includes a pair of cam followers 22 which engage a cam 23 mounted for rotation on a shaft driven by a motor 24 through a variable speed gearbox 25. This drive is independent of the drive to the other parts of the apparatus.

In use, the fabric moves in the direction of the arrow 26 and the lick roller 12 rotates to draw dye liquor from the bath 11 on its surface. The doctor blade 13 strips the dye liquor from the lick roller 12 in the form of a film of dye liquor and this falls as droplets from the lower edge of the doctor blade onto the corrugated sheet 14, under the influence of gravity.

The corrugated sheet 14 is oscillated by the rotating cam 23 which causes the plate 20 to oscillate in a vertical direction and this motion is transferred to the corrugated sheet 14 through the member 19, lever arm 18, rod 17 and arms 16 and 15.

The drops of dye liquor falling from the lower ends of the channels 14A in the corrugated sheet 14 are scattered by the oscillatory motion of the corrugated sheet 14 so that they are deposited on the pile fabric 10 in paths determined by the contour of the cam 23.

As already explained the size of the drops may be varied by varying the viscosity of the dye liquor and/or by changing the angle of the corrugations of the corrugated sheet 14. The characteristics of the pattern in which the drops are deposited on the fabric may be varied by changing the cam 23 or by altering its rotational speed by adjustment of the gearbox 25. The pattern may also be varied by altering the angle of the doctor blade 13 and its relation to the lick roller 12 and by altering the rotational speed of the lick roller 12. It may also be altered by varying the size of the channels 14A in the corrugated sheet 14 and by changing the speed of travel of the fabric 10.

Additional lick rollers, doctor blades and oscillating corrugated sheets may be provided subsequent to the one shown and described above with reference to the drawing. These may either oscillate at the same frequency as the corrugated sheet 14 under control of the same cam or separate cams having the same profile or may oscillate at other frequencies under the control of cams having different profiles.

The fabric may be subjected to other dyeing steps before it reaches the corrugated sheet 14. It may be provided with a solid background colour or a pattern by feeding the fabric continuously through a nip between a driven printing roller and an associated backing roller, the driven printing roller having a continuous impervious surface wholly or at least partly covered with a material which readily absorbs dye liquor and which is charged with dye liquor by passing through a trough of dye liquor. Such a procedure is described in British Patent No. 827,342.

Alternatively, a background colour may be provided by passing the fabric through a padding trough or mangle as described in our British Patent No. 1,395,979 prior to passing beneath the corrugated sheet 14.

After all the printing steps have been completed, the fabric preferably passes into a steamer to enable full fixation of the dye on the fabric. The steamer may be horizontal or loop or festoon or a combination of these as described in our British Patent No. 1,395,979.

EXAMPLE

A tufted carpet was fed continuously at a rate of 10 feet per minute through a printing unit which applied to its pile surface a background colour derived from a dye liquor of the following composition:

| | | |
|---|---|---|
| Dyestuffs | Tectilon Blue 6 G | 0.75 g/l |
| | Tectilon Yellow R | 0.02 g/l |
| Thickener | Meyprogum PAT | 200 g/l (of a 2% solution) |
| Buffering agent | Citric Acid | 10 g/l |
| Auxiliary agent | Tinegal JSE/2 | 10 g/l |

It then received spatter colour by passage in succession beneath three units of the kind illustrated in the drawing. In each of these the doctor blade had a length of 4 meters and a width of 9 inches and was inclined at 30° to the horizontal and the lick roller rotated at 6 r.p.m. The corrugated sheet in each unit had channels 4 inches long and ¾ inch wide and received 30 oscillations per minute from a three step cam rotating at 5 r.p.m.

The dye liquors in the units contained different dyestuffs but the same thickener, buffering agent and auxiliary agent. They were of the following compositions:

| | | 1 | 2 | 3 |
|---|---|---|---|---|
| Dyestuffs | Nylomine Yellow AG | 0.6 g/l | 1.5 g/l | 0.8 g/l |
| | Nylomine Blue AG | 1.2 g/l | 3.0 g/l | 0.1 g/l |
| | Nylomine Yellow A4R | — | — | 0.5 g/l |

Thickener Meyprogum PAT 300 g/l (of a 2% solution)
Buffering agent Citric Acid 10 g/l
Auxiliary agent Tinegal JSE/2 2 g/l Meyprogum is a guar gum supplied by Meyhall A.G. of Switzerland and it serves to control the viscosity of the dye liquor. Tinegal is an ethylene oxide condensate supplied by Ciba Geigy Ltd. and is a wetting agent which serves to counteract the hydrophobic nature of nylon fibre of which the pile of the carpet consists.

What I claim is:

1. Apparatus for dyeing a length of pile fabric moving continuously with its pile surface uppermost, comprising a trough to contain dye liquor, a rotatable lick roller mounted in the trough with its axis extending transversely to the direction of travel of the fabric, a doctor blade extending parallel to the lick roller with its upper edge in contact with the lick roller, to pick up a film of dye liquor from the lick roller, the doctor blade having a smooth, uninterrupted upper surface, a corrugated sheet extending transversely to the direction of travel of the fabric and disposed beneath the lower edge of the doctor blade, the corrugated sheet collecting in its channels by gravity from the doctor blade a number of parallel streams of drops of dye liquor from which the drops fall directly on to the fabric, and means for imparting oscillation to the corrugated sheet in a direction transverse to the direction of travel of the fabric.

2. Apparatus as claimed in claim 1, in which the lower edge of the corrugated sheet is spaced from the fabric by a distance in the range of 50 to 200 mm.

3. Apparatus as claimed in claim 1 in which the corrugations in the sheet are longer, at the bases of the channels formed by the corrugations, in the direction of the length of the channels than the corrugations which form the crests between the channels.

* * * * *